US008819882B2

(12) United States Patent
De Wit et al.

(10) Patent No.: US 8,819,882 B2
(45) Date of Patent: Sep. 2, 2014

(54) COMBINATION OF A TRAY AND A CLEANING DEVICE FOR CLEANING SURFACES

(75) Inventors: Bastiaan Johannes De Wit, Nuis (NL); Michael Van Den Bosch, Drachten (NL); Johannes Tseard Van Der Kooi, Hurdegaryp (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/982,840

(22) PCT Filed: Feb. 7, 2012

(86) PCT No.: PCT/IB2012/050543

§ 371 (c)(1),
(2), (4) Date: Jul. 31, 2013

(87) PCT Pub. No.: WO2012/107876

PCT Pub. Date: Aug. 16, 2012

(65) Prior Publication Data

US 2013/0305468 A1 Nov. 21, 2013

(30) Foreign Application Priority Data

Feb. 8, 2011 (EP) ..... 1153699

(51) Int. Cl.
*A47L 11/292* (2006.01)

(52) U.S. Cl.
USPC ..... 15/49.1; 15/52.1; 15/246.2

(58) Field of Classification Search
USPC ..... 15/49.1, 52.1, 246, 246.2
See application file for complete search history.

(56) References Cited

U.S. PATENT DOCUMENTS 5,920,939 A * 7/1999 Worwag ..... 15/41.1
7,152,267 B2 * 12/2006 Kaleta ..... 15/42

FOREIGN PATENT DOCUMENTS

JP 4005940 A 1/1992
JP 2005211426 A 8/2005

* cited by examiner

*Primary Examiner* — Randall Chin

(57) ABSTRACT

In a cleaning device, a head of the device in which a brush is arranged, can get contaminated by particles and/or droplets picked up by the brush during one or more cleaning actions. In order to clean the head, the cleaning device is placed on a tray filled with an amount of cleaning liquid, and the cleaning device is operated for a period of time. During that time, the head is flushed with the cleaning liquid, where the brush serves for picking up the liquid from the tray and releasing the liquid in the direction of components of the head. The tray has an elevated portion, and the brush is positioned on that elevated portion to allow for gradual wetting of the brush.

10 Claims, 3 Drawing Sheets

COMBINATION OF A TRAY AND A CLEANING DEVICE FOR CLEANING SURFACES

CROSS-REFRENCE TO PRIOR APPLICATIONS

This application is the U.S National Phase application under 35 U.S.C. §371 of International Application No. PCT/IB2012/050543, filed on Feb. 7, 2012, which claims the benefit of European Patent Application No. 1153699.1, filed on Feb. 8, 2011. These applications are hereby incorporated by reference herein.

FIELD OF THE INVENTION

In general, the present invention relates to a method for cleaning a head of a cleaning device for cleaning surfaces, in which head at least one brush for contacting surfaces to be cleaned is rotatably arranged.

In particular, the present invention also relates to a combination of a tray and a cleaning device for cleaning surfaces, wherein the cleaning device comprises a head having an open side for facing surfaces to be cleaned, and at least one brush for contacting surfaces to be cleaned, which is rotatably arranged in the head, wherein the tray is adapted to receive and accommodate at least a portion of the head of the cleaning device, and to cover the open side of the head, wherein the tray comprises a bottom part and standing walls connected to the bottom part, wherein the bottom part serves for supporting the head of the cleaning device, and wherein the standing walls jointly serve for encompassing the head of the cleaning device.

BACKGROUND OF THE INVENTION

In practice, various types of a cleaning device for cleaning surfaces are known. A well-known example of such a cleaning device is a vacuum cleaner, which is capable of removing dust and dirt particles from surfaces like floors under the influence of a suction force. Another example is a device which comprises a head having an open side for facing surfaces to be cleaned, and at least one brush for contacting surfaces to be cleaned, which is rotatably arranged in the head. The present invention relates to this type of cleaning device, which may comprise means for realizing a suction force at the head, like a vacuum cleaner, but which can also be realized without such means.

The brush of the cleaning device is provided with a plurality of brush hairs. It is possible for these brush hairs to be extremely soft and flexible. For example, the brush hairs can have a linear mass density which is lower than 150 g per 10 km. In such a case, a cleaning action of a surface is not performed by scrubbing the surface, as may normally be expected when a brush is used, but by putting the brush hairs alternately in and out of contact with the surface during rotation of the brush. In particular, during one revolution of the brush, the brush hairs remove particles and/or liquid droplets from a soiled surface on the basis of the fact that the particles and/or the droplets adhere to the brush hairs, or are at least pushed from their initial place by the brush hairs, and fling away the particles and/or the droplets when they reach a position in which they are free from contact to the surface and in which they can be fully outstretched. In the head of the cleaning device, in which the brush is arranged, there are means for receiving the particles and/or the droplets, and for possibly transporting the particles and/or the droplets towards a space where they are collected. The cleaning device may be equipped with means for realizing a suction force at the head, for example, by creating a vacuum, in order to direct the particles and/or the droplets in a desired direction once they are released from the brush hairs.

In order to have an effective process of flinging away particles and/or droplets which have been removed from a surface, the rotation of the brush needs to take place at a certain angular velocity. The angular velocity of the brush may be chosen to be such that an acceleration at tips of the brush hairs can be higher than 3,000 m/sec$^2$ at some point, which is the case when the angular velocity is at least 6,000 revolutions per minute, and a diameter of the brush is in a range of 20 to 80 mm when the brush hairs are fully outstretched, for example.

It is possible for the cleaning device to supply a cleaning liquid to the rotating brush in order to promote the adherence of particles to the brush hairs and/or to realize an additional cleaning effect on a surface to be cleaned, but this is not necessary. In any case, when the cleaning device having at least one brush as mentioned is used, it happens that the head in which the brush is arranged gets contaminated with the particles and/or the droplets which are picked up by the brush hairs and released inside the head. As a consequence, a user of the cleaning device is compelled to clean the head before storing the device. This is an unfavorable aspect of the use of the device, as cleaning the head requires a flushing action of the head, which is not easy to handle, and is quite bothersome.

JP 2005 211426 discloses a cleaning device comprising two cleaning tools, namely a rotatably arranged brush and a rotatably arranged adsorption sheet roller. The cleaning device is combined with a fixed station. When the cleaning device is put in place on the fixed station, washing of the brush and the adsorption sheet roller is performed. In particular, an upper surface of the fixed station is provided with a crevice for receiving the brush and a crevice for receiving the adsorption sheet roller. A cleaning liquid is supplied to the crevices by means of a pipe system. By rotating the brush and the adsorption sheet roller, the brush and the adsorption sheet roller are washed by the cleaning liquid.

SUMMARY OF THE INVENTION

It is an object of the present invention to provide a method for cleaning a head of a cleaning device for cleaning surfaces, in which head at least one brush for contacting surfaces to be cleaned is rotatably arranged, which method allows for a more or less automated cleaning process of the head which does hardly require any effort from a user of the cleaning device. The object is achieved by means of a method comprising the steps of providing a tray which is adapted to contain liquid, putting the cleaning device in at least one predetermined position on the tray, filling the tray with an amount of liquid, and activating the cleaning device to rotate the brush, wherein the at least one brush is kept above a level of the liquid with which the tray is filled.

By using a tray filled with liquid, particularly a cleaning liquid, the problem of the bothersome cleaning of the head of the cleaning device is solved. When the cleaning device is in place on the tray or is moved with respect to the tray, and the brush is rotated and allowed to contact the liquid in the process, it happens that the liquid is gradually transported from the tray to the head by the rotating brush, on the basis of the same principle as valid for removing dust particles and/or liquid droplets from a soiled surface. Hence, the head gets flushed by the liquid, and is cleaned as a result thereof, while all that a user needs to do is providing the tray, putting the cleaning device in an appropriate position with respect to the tray, or moving the cleaning device over the tray, and activating the cleaning device for a certain amount of time. Another action which needs to be taken by the user may be filling the tray with the liquid, but it is even possible to have this action automated, namely when the cleaning device is adapted to supply the liquid. In any case, when the method according to the present invention is applied, there is no need for cleaning parts by hand, and cleaning liquid is supplied in a most convenient way, namely in a tray, wherein the user does not need to watch for any spillage of the liquid.

Preferably, the cleaning device comprises means for realizing a suction force at the head, and these means are activated at the same time that the brush is activated to rotate. In that case, it is advantageous if the head of the cleaning device is continuously kept at a certain position with respect to the tray and a snug fit of the head in the tray is realized, at least when the cleaning device is activated. The reason is that the suction force may be used to have a continuous flow of liquid inside the tray towards the brush until all of the liquid is used. In order to let the suction force act effectively on the liquid, it is important that the head and the tray constitute as much as possible a closed entirety, so that a flow of air which is strong enough for inducing a flow of liquid can be obtained. This can be realized by the snug fit of the head in the tray as mentioned. In an advantageous embodiment, the tray is provided with flexible element such as rubber elements, for example, which can be sucked inwardly when the operation of the cleaning device is started, and which guarantee the snug fit in that way during the cleaning process of the head. In that case, it is easy for a user to insert the head in the tray, wherein the snug fit is only realized when necessary, namely during the cleaning process.

According to the present invention, it is favorable to keep the at least one brush of the cleaning device above the level of the liquid with which the tray is filled. In that case, it is possible for the brush to get only gradually wetted by liquid which is made to flow towards it, so that it is prevented that the brush gets very heavy with a large amount of liquid and is therefore harder to rotate than under normal conditions. Hence, by keeping the brush above the level of the liquid, the energy needed for rotating the brush can be kept in a normal, acceptable range.

The tray comprises a bottom part, standing walls connected to the bottom part, and an elevated portion arranged on the bottom part. When the method according to the present invention is carried out, the brush of the cleaning device can be kept at a position with respect to the tray at which the brush is contacted and indented by the elevated portion. This is especially applicable in case the cleaning device comprises means for realizing a suction force at the head on the basis of a vacuum, as the vacuum is enhanced by the indentation, and the ability to suck liquid towards the brush is enhanced as a result thereof.

In general, in order to achieve gradual wetting of the brush, it is advantageous to use a tray comprising two areas which are separated by a barrier, to place the brush in one of the areas, and to fill the tray only in another of the areas. Provided that the liquid is made to pass the barrier and to flow from the latter area to the first area during operation of the cleaning device, wetting of the brush is realized after all, and this is done in the desired gradual fashion with a flow of liquid which is kept limited by the barrier.

Accordingly, the present invention provides a combination of a tray and a cleaning device for cleaning surfaces, wherein the cleaning device comprises a head having an open side for facing surfaces to be cleaned, and at least one brush for contacting surfaces to be cleaned, which is rotatably arranged in the head, wherein the tray is adapted to receive and accommodate at least a portion of the head of the cleaning device, and to cover the open side of the head, wherein the tray comprises a bottom part and standing walls connected to the bottom part, wherein the bottom part serves for supporting the head of the cleaning device, and wherein the standing walls jointly serve for encompassing the head of the cleaning device. Furthermore, the tray comprises two areas which are separated by a barrier protruding from the bottom part, wherein one of the areas is an elevated portion which is arranged on the bottom part, and which is located at the position on the bottom part where the at least one brush of the cleaning device is present when the cleaning device is in place on the tray.

As explained in the foregoing, on the basis of the presence of the elevated portion, an advantageous effect is found in the fact that direct contact of the brush to the liquid can be prevented, so that it is achieved that a gradual wetting process of the brush is realized, as a result of which the brush does not get too heavy, and can be rotated at normal power.

Preferably, a ring-shaped entirety of the standing walls of the tray is adapted to snugly surround at least a portion of the head of the cleaning device, so that, as explained in the foregoing, the effect of a suction force in the head on the liquid can be enhanced, whereby a continuous flow of the liquid towards the brush can be realized, all the time during operation of the cleaning device, until all of the liquid is used and the tray is practically empty.

In a practical embodiment, the barrier for separating the two areas of the tray can be designed as a part of an elevated portion which is arranged on the bottom part of the tray. For example, such an elevated portion may be ring-shaped, and may be positioned such as to surround the area of the bottom part where the brush is present when the cleaning device is in place on the tray. When filling of the tray takes place in the area outside of the area surrounded by the elevated portion, the brush is prevented from getting wet from direct contact to the liquid. Instead, the liquid is gradually supplied to the brush when the brush is rotated, wherein pumping forces are exerted on the liquid in order to make the liquid flow from the one area to the other, and to make the liquid pass the elevated portion in the process.

When an elevated portion is applied in the tray, it does not necessarily need to be ring-shaped, and to have a function of surrounding the brush during a cleaning operation. In particular, it is also possible that this portion is located at the very position on the bottom part where the brush of the cleaning device is present when the cleaning device is in place on the tray. In that case, an area of the tray outside the elevated portion is adapted to receive and contain liquid and to allow for a flow of liquid directed towards the elevated portion. In fact, the barrier is constituted by a circumferential surface of the elevated portion, and the liquid is drawn up the elevated portion, over this barrier, when the brush is rotated and pumping forces are exerted on the liquid.

In the following, when the term "elevated portion" is used, this term should be understood such as to relate to the second type of elevated portion as mentioned, i.e. the elevated portion which is used for keeping the brush at a level above a level of the liquid in the tray, and which may be shaped like a bulge arranged on the bottom part. In a tray comprising such an elevated portion, it is advantageous if the bottom part of the tray comprises surfaces which are slanting towards that portion, so that a flow of liquid towards that portion can be facilitated. In a practical embodiment, the elevated portion comprises at least one gutter-shaped portion having a concave surface in a transverse direction. Such a portion is very well capable of partly enclosing and indenting a brush, assuming that the brush has a cylindrical shape with a circular circumference. For example, the brush may be shaped like a roller covered with brush hairs.

Preferably, in the tray, spaces are present between the elevated portion and portions of the standing walls, and areas of the tray which are the lowest as seen in a normal, operational position of the tray with the bottom part down and the standing walls extending upwardly from the bottom part, are present in the spaces. When the elevated portion comprises the gutter-shaped portion as mentioned in the foregoing, the spaces as mentioned may be present at both ends of the gutter. On the basis of the presence of the lowest areas of the tray near the elevated portion, it is ensured that the supply of liquid to the brush of the cleaning device can take place in a proper manner, and is supported by gravity.

It is likely for the cleaning device to comprise at least one wheel for supporting the head and allowing the head to roll along surfaces to be cleaned. In that case, the tray may comprise at least one recess which is located at a position on the tray where the at least one wheel of the cleaning device is present when the cleaning device is in place on the tray, and which is arranged in a slanting surface of the tray. A recess may be an area where liquid stays behind, but by having the recess for receiving and accommodating a wheel of the cleaning device in a slanting surface, it can be ensured that all of the liquid is allowed to flow towards the brush.

In an advantageous embodiment, at least a portion of the tray is covered with a hydrophobic material, so that the flow of liquid towards the brushes can be promoted on the basis of a tendency of the liquid not to adhere to the tray.

It is most practical for the tray to comprise a component indicating a maximum level of the liquid in the tray, so that a user may know to which extent the tray can be filled. In order to avoid a situation of the level of the liquid getting too high, the tray may be provided with means for determining a maximum level of liquid in the tray. Such means may be means for allowing the liquid to flow out of the tray when a certain level is exceeded. For example, at least one notch may be provided in a ring-shaped entirety of the standing walls of the tray, so that excessive liquid can automatically be discharged from the tray, and a process of gradually wetting the brush and cleaning the head in a controlled manner is not disturbed. Furthermore, unsafe situations in which the liquid may reach certain parts of the cleaning device which should remain dry are avoided. Another possibility applicable to the indicating component is that an overall height of at least a considerable portion of the standing walls determines the maximum level of the liquid inside the tray. As soon as the level of the liquid gets too high, the tray overflows with the liquid, so that the liquid is automatically discharged from the tray.

In order not to hinder a flow of liquid towards the brush as positioned on an elevated portion during a cleaning process of the head of the cleaning device, the formation of obstructions in the tray, particularly surfaces slanting in another direction than towards the elevated portion, as a result of elastic deformation or creep of the tray which may take place under the influence of the weight of the cleaning device should be avoided. In view thereof, it is advantageous if the tray comprises at least three supports at another side than a side for receiving at least a portion of the head of the cleaning device, i.e. a side which is a bottom side of the tray in a normal, operational position of the tray, wherein the supports are located at positions which are subjected to pressure by components of the head of the cleaning device when the cleaning device is in place on the tray. By having supports at the very positions where pressure is concentrated, elastic deformation or creep of the tray is avoided, and all shape features provided for promoting a flow of liquid towards the elevated portion remain intact.

For sake of completeness, it is noted that the cleaning device can comprise two brushes, which are rotated in opposite directions during operation. In any case, the rotation of the at least one brush contributes to the suction of liquid towards the brush on the basis of the fact that the combination of the brush and a surface which is arranged quite close to the brush can act like a kind of gear pump.

According to the present invention, a tray is provided, which is adapted for multifunctional use in combination with a cleaning device for cleaning surfaces, which cleaning device comprises a head having an open side for facing surfaces to be cleaned, and at least one brush for contacting surfaces to be cleaned, which is rotatably arranged in the head, wherein one function of the tray is containing an amount of liquid to be used in a process of cleaning the head of the cleaning device after use, and wherein another function of the tray is receiving liquid dripping from the head of the cleaning device after use and/or a cleaning process as mentioned.

The above-described and other aspects of the present invention will be apparent from and elucidated with reference to the following detailed description of a tray adapted to be used in a process of cleaning a head of a cleaning device comprising two brushes which are arranged in the head, and a combination of the tray and the cleaning device.

BRIEF DESCRIPTION OF THE DRAWINGS

The present invention will now be explained in greater detail with reference to the figures, in which equal or similar parts are indicated by the same reference signs, and in which.

DETAILED DESCRIPTION OF EMBODIMENTS

Figure 1:
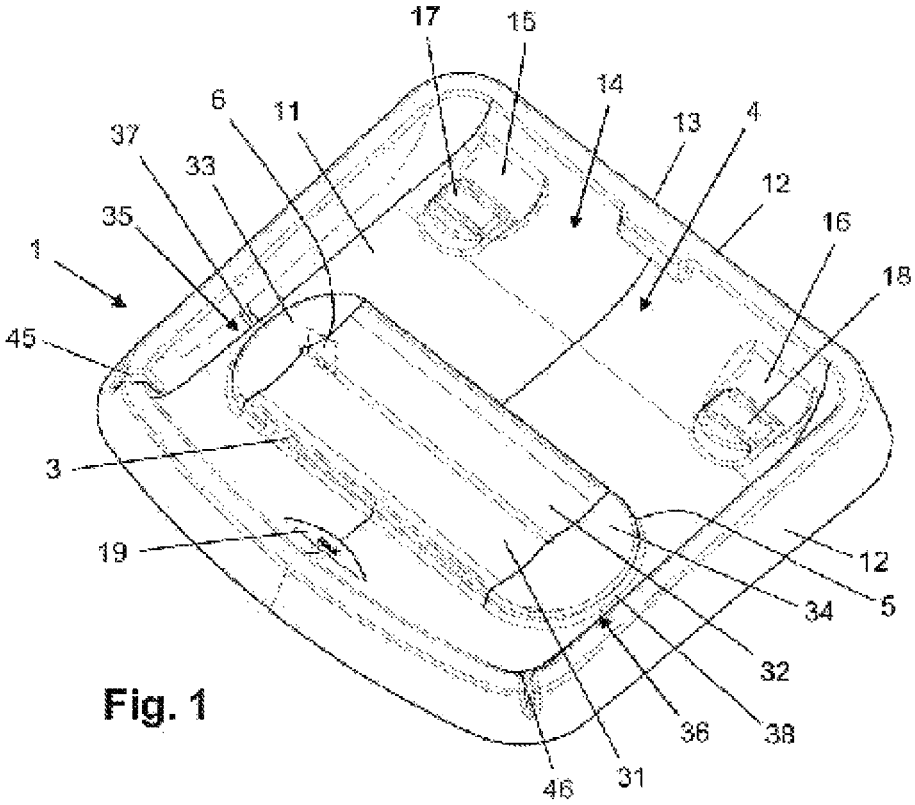
FIG. 1 diagrammatically shows a perspective top view of a tray according to the present invention, which is adapted to be used in a process of cleaning a head of a cleaning device comprising two brushes which are arranged in the head.
Figure 2:
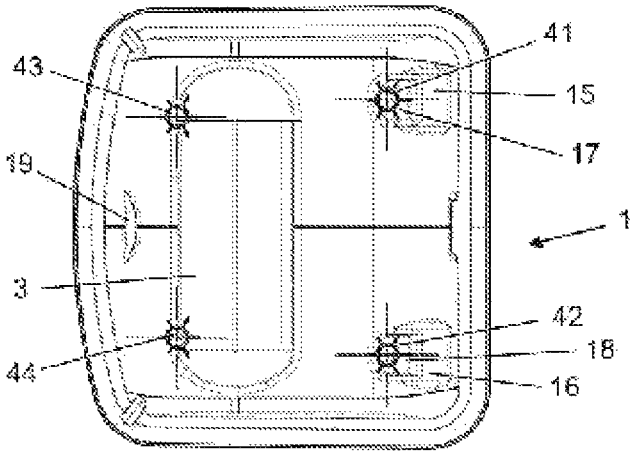
FIG. 2 diagrammatically serves to illustrate a positioning of supports arranged at a bottom side of the tray shown in FIG. 1.
Figure 3:
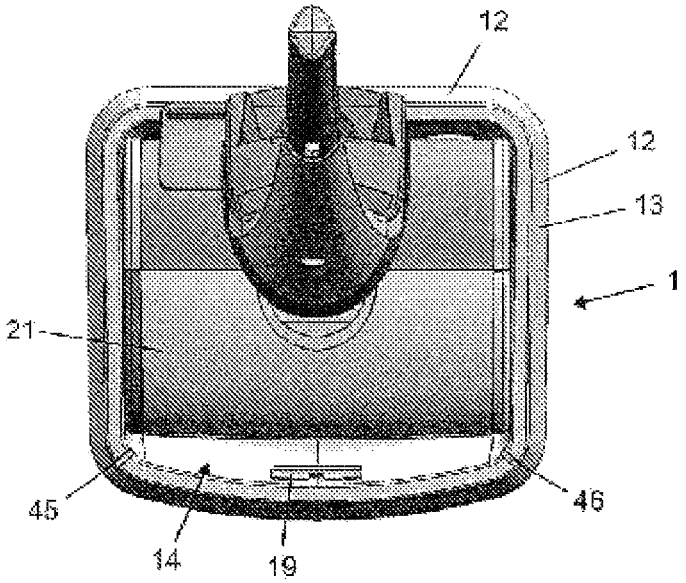
FIG. 3 diagrammatically shows a top view of the tray and the head of the cleaning device, in a situation in which the head is in place on the tray.
Figure 4:
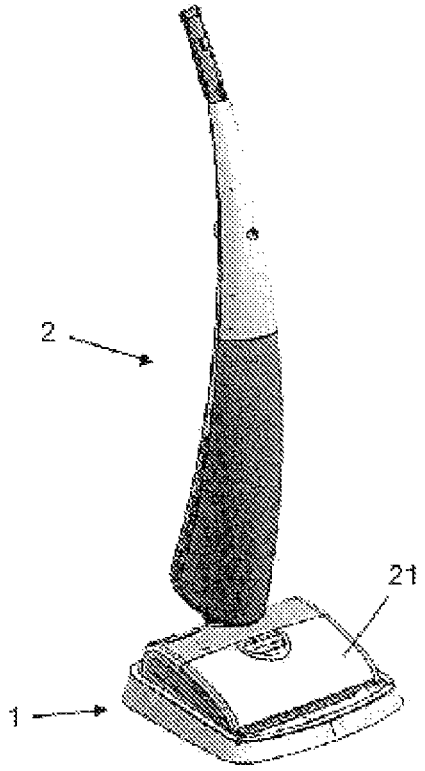
FIG. 4 diagrammatically shows a perspective view of the combination of the tray and the cleaning device, wherein the cleaning device is in place on the tray.

FIGS. 1 and 2 show a tray 1 according to the present invention, which is intended to be applied in combination with a cleaning device 2 for cleaning surfaces, particularly a cleaning device 2 comprising a head 21 having an open side for facing surfaces to be cleaned, and two brushes 22, 23 for contacting surfaces to be cleaned, which are rotatably arranged in the head 21. FIG. 3 shows the head 21 of the cleaning device 2, in a situation in which the head 21 is in place on the tray 1, and FIG. 4 shows the cleaning device 2, in a situation in which the cleaning device 2 is in place on the tray 1. For sake of completeness, it is noted that FIG. 4 shows both the tray 1 and the cleaning device 2 in a normal, functional position. The design of the tray 1 and the way in which the tray 1 is used to interact with the head 21 of the cleaning device 2 will be explained in the following.

In general, like any tray, the tray 1 according to the present invention comprises a bottom part 11 and standing walls 12 connected to the bottom part 11. The standing walls 12 jointly constitute a ring-shaped entirety 13. The tray 1 has an open space 14, which is suitable for containing liquid, as will be explained later. Furthermore, the open space 14 is suitable for receiving and accommodating a portion of the head 21 of the cleaning device 2. When the head 21 is in place on the tray 1, the open side of the head 21 is covered by the tray 1. The bottom part 11 of the tray 1 serves for supporting the head 21 of the cleaning device 2, and the entirety 13 of standing walls 12 of the tray 1 serves for encompassing the head 21, partly with a snug fit as will be explained later.

The tray 1 comprises an elevated portion 3 which is arranged on the bottom part 11, at a position where the brushes 22, 23 of the cleaning device 2 are present when the cleaning device 2 is in place on the tray 1. For the purpose of partly surrounding the brushes 22, 23, the elevated portion 3 comprises two gutter-shaped portions 31, 32 having a concave surface in a transverse direction. In the shown example, at both ends of the gutter-shaped portions 31, 32, the elevated portion 3 comprises transition portions 33, 34 which constitute a smooth transition between the gutter-shaped portions 31, 32 and an edge of the elevated portion 3.

In an area where a standing wall 12 is connected to the bottom part 11, which is a slanting area, two recesses 15, 16 are arranged in the tray 1, which serve for receiving and accommodating wheels 24 of the cleaning device 2. Elevated portions 17, 18 having a planar top surface are associated with the recesses 15, 16 in order to facilitate a process of the wheels 24 finding their place in the recesses 15, 16 when the cleaning device 2 is put in place on the tray 1, and to ensure that the wheels 24 stay in place during the time that the cleaning device 2 is present on the tray 1. These elevated portions 17, 18 serve for supporting a portion of the head 21 close to the wheels 24, and will hereinafter be referred to as top supports 17, 18.

At another side of the tray 1 than the side where the recesses 15, 16 are arranged, an elevated portion 19 is arranged on the bottom part 11, which serves for indicating to a user a maximum level of liquid in the tray 1, and which will hereinafter be referred to as level indicator 19. The use of liquid in the tray 1 will be explained later.

FIG. 2 illustrates the fact that the tray 1 comprises a number of supports 41, 42, 43, 44 for supporting the tray 1 on the ground. Naturally, these supports 41, 42, 43, 44 are present at a bottom side of the tray 1, i.e. another side than the side where the tray 1 has the open space 14 for receiving and accommodating the head 21 of the cleaning device 2. In view of this fact, these supports 41, 42, 43, 44 will hereinafter be referred to as bottom supports 41, 42, 43, 44. In order to have a firm support and avoid elastic deformation or creep of the tray 1 when the cleaning device 2 is placed on the tray 1, the positioning of the bottom supports 41, 42, 43, 44 is chosen such that the bottom supports 41, 42, 43, 44 are present at the very places where the pressure exerted by the cleaning device 2 on the tray 1 is concentrated. In the shown example, the positions of two bottom supports 41, 42 correspond to the positions of the top supports 17, 18, and the positions of two other bottom supports 43, 44 are on the other side of the tray 1, at an edge of the elevated portion 3 facing the level indicator 19. Hence, at the top side of the tray 1, one side of the head 21 can rest on the top supports 17, 18 near the recesses 15, 16 for receiving and accommodating the wheels 24 of the cleaning device 2, and another side of the head 21 can rest on the edge of the elevated portion 3 as mentioned.

The cleaning device 2 as shown in FIG. 4 comprises two brushes 22, 23, which are intended to be used for contacting surfaces to be cleaned. The brushes 22, 23 are provided with a plurality of extremely flexible hairs, which are capable of picking up particles and/or droplets from the surfaces on the basis of adherence effects, and which are furthermore capable of releasing the picked-up particles and/or droplets at a position inside the head 21 of the cleaning device 2. In fact, when the brushes 22, 23 are rotated, the brush hairs pick up particles and/or droplets in one part of each revolution, and fling away the picked-up particles and/or droplets in another part of each revolution. It is preferred for the brushes 22, 23 to be kept at a position with respect to the surface in which the brushes 22, 23 are indented at the side where the surface is, as a length along which the brush hairs contact the surface is enlarged in this way, and the effect of releasing picked-up particles and droplets is enhanced during a stage in which the brush hairs move from an indented condition to an outstretched condition.

The cleaning device 2 comprises means (not shown) for creating a suction force at the head 21 on the basis of a vacuum. Under the influence of the suction force, the particles and/or droplets released by the brushes 22, 23 are transported further to a defined space (not shown) inside the cleaning device 2. For sake of completeness, it is noted that the cleaning device 2 is suitable for both dry cleaning and wet cleaning. The cleaning device 2 may have means for supplying a cleaning liquid to a surface to be cleaned, possibly through the brushes 22, 23, but this is not necessary. It is also possible for the cleaning device 2 to use liquid which is already present on the surface. This liquid may even be soiled liquid, as all of the liquid is removed from the surface by the hairs of the brushes 22, 23 in the end.

When the cleaning device 2 has been used for carrying out one or more cleaning actions, the head 21 is contaminated with particles and/or droplets which have been picked up and released by the brush hairs. Most of the particles and/or droplets are transported further under the influence of the suction force, but there is always a small amount which adheres to components of the head 21 and needs to be removed from there. Hence, there is a need for a cleaning action of the head 21 from time to time. According to the present invention, the tray 1 does not only play a role in supporting the cleaning device 2 on the ground and receiving droplets which may drip from the head 21 after the cleaning device 2 has been used for cleaning a surface, but is also suitable to be used for cleaning the head 21 by means of an amount of cleaning liquid.

A cleaning action of the head 21 involves the following steps. First, the cleaning device 2 is placed on top of the tray 1, in a proper manner, i.e. with the wheels 24 stored in the recesses 15, 16 of the tray 1, and with a portion of the head 21 snugly surrounded by the ring-shaped entirety 13 the standing walls 12. For the purpose of facilitating the placement of the cleaning device 2 on the tray 1, it is advantageous if the standing walls 12 have a tapering shape. In the shown example, the head 21 has a rectangular circumference, and the tray 1 has a rectangular/square appearance as well. When the cleaning device 2 is in place on the tray 1, three sides adjoin the entirety 13 of the standing walls 12, and one side is free from the said entirety 13. The latter side extends at some distance from the standing wall 12 where the level indicator 19 is located. Hence, when the cleaning device 2 is placed on the tray 1, an open space is left open on the tray 1 between the level indicator 19 and the one side of the cleaning device 2 that os free from the entirety 13. Through this open space, the cleaning liquid to be used in the process of leaning the head 21 can be supplied to the tray 1 by a user, wherein the user is capable of seeing the level indicator 19.

It is noted that at the side of the head 21 which does not adjoin a standing wall 12, the head 21 rests on the edge of the elevated portion 3 of the tray 1 facing the level indicator 19. All in all, the head 21 contacts the tray 1 along a considerable portion of its circumference, which contributes to the realization of a suction force inside the tray 1 under the influence of a vacuum generated by the cleaning device 2 during operation, and thereby to the flow of cleaning liquid generated by a flow of air.

When the user supplies the cleaning liquid to the tray 1, he/she can use the level indicator 19 for determining the correct amount of liquid. When the user pours more liquid in the tray 1 than the maximum as indicated, the liquid is discharged from the tray 1 through two notches 45, 46 which are arranged in the entirety 13 of standing walls 12, at the side where the level indicator 19 is located, so that a user may immediately notice a discharge of excess liquid. The discharge of excess liquid is a safety measure, as with this measure, it is avoided that liquid can enter areas of the cleaning device 2 which should remain dry under all circumstances.

The maximum level as indicated is chosen such that the brushes 22, 23 of the cleaning device 2, which are supported by the elevated portion 3, remain dry when the tray 1 is filled, wherein the liquid is initially only present in an area 4 outside of the elevated portion 3, and a circumferential surface 5 of the elevated portion 3 constitutes a barrier which prevents the liquid from reaching the brushes 22, 23 as long as the liquid is not put in motion. If the brushes 22, 23 would be allowed to get wet with the liquid right away, the brushes 22, 23 could become so heavy that it is difficult for the cleaning device 2 to start a rotation of the brushes 22, 23, which is a next step in the cleaning process.

For sake of completeness, it is noted that, as an alternative within the scope of the present invention, it is possible for the cleaning device 2 to be adapted to supply the cleaning liquid, preferably in a predetermined dose when activated by the user. In particular, the cleaning device 2 may comprise a suitable tank for containing the liquid, and means for supplying the liquid from the tank to the head 21 of the cleaning device 2. Supplying the liquid by means of the cleaning device 2 in a predetermined dose saves the user the trouble of pouring the liquid into the tray 1 and checking the level of the liquid by means of the level indicator 19.

Figure 5:
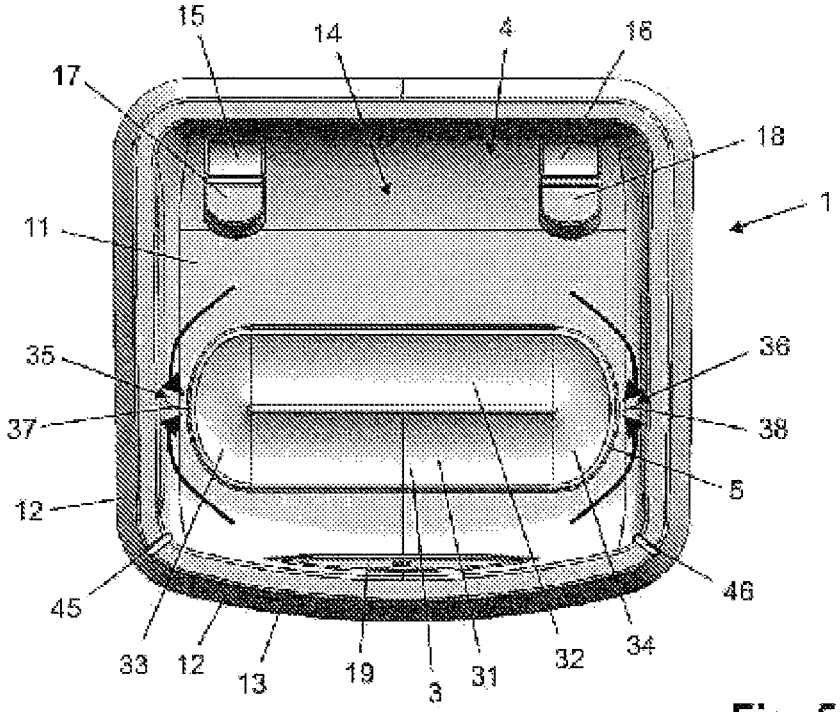
FIG. 5 diagrammatically shows a top view of the tray, and serves to illustrate a flow of cleaning liquid in the tray.

By making the cleaning device 2 operate for a certain period of time, the following takes place. The brushes 22, 23 start to rotate, and a gear pump effect between each of the brushes 22, 23 and the underlying surface of the elevated portion 3 is obtained in the process. The liquid which is present in the tray 1 is put in motion, both under the influence of the pumping effect and the suction force exerted by the cleaning device 2. The suction force, which is created on the basis of vacuum, is applied to a maximum extent on the basis of the fact that there is a more or less airtight coupling of the head 21 to the tray 1. It is possible to have additional elements (not shown) in the tray 1 for performing a sealing function. The liquid is drawn to the elevated portion 3 at two sides, i.e. at the sides where the transition portions 33, 34 are located, and where there are spaces 35, 36 between the elevated portion 3 and the relevant portion of a standing wall 12, passes the circumferential surface 5 of the elevated portion 3 from those sides, and reaches the brushes 22, 23. The flow of liquid in the tray 1 is diagrammatically indicated by means of arrows in FIG. 5. In fact, the relief of the bottom part 11 of the tray 1 is aimed at having a natural tendency of the liquid to flow towards the elevated portion 3, at the sides as mentioned. To this end, two lowest areas 37, 38 of the tray 1 are present at those sides of the elevated portion 3, wherein surfaces of the tray 1 are made such as to slant towards those areas 37, 38, and even the recesses 15, 16 for receiving and accommodating the wheels 24 of the cleaning device 2 are designed such that liquid may easily flow out. The spaces 35, 36 where the lowest areas 37, 38 are located are relatively narrow, and this fact contributes to the generation of a flow of liquid, from various positions in the tray 1 to the lowest areas 37, 38, and from the lowest areas 37, 38 to the brushes 22, 23 on the elevated portion 3, via the circumferential surface 5 of the elevated portion 3. A flow of air is the basis of the flow of liquid, which can be strong enough with the relatively narrow spaces 35, 36, and which is caused by both the suction of air by the cleaning device 2 and the gear pump effect between the brushes 22, 23 and the underlying surfaces. As the tray 1 is firmly supported by the bottom supports 41, 42, 43, 44 at well-chosen positions as described in the foregoing, the creation of additional low areas under the influence of elastic deformation or creep of the tray 1 following from pressure exerted by the cleaning device 2 on the tray 1 is avoided, so that it is ensured that the flow of liquid in the tray 1 can be as intended.

When the brushes 22, 23 are rotated and the suction force is exerted, the liquid is gradually drawn to the brushes 22, 23 from the area 4 outside the elevated portion 3. The hairs of the brushes 22, 23 pick up the liquid and release the liquid in the head 21, in the same manner as during a normal cleaning action on a surface. As a result, the head 21 is flushed with the cleaning liquid, and the contamination is removed and transported to the space in the cleaning device 2 for receiving and temporarily storing dust and dirt particles and soiled liquid. The cleaning action is continued until practically all of the cleaning liquid has been used and the tray 1 is practically empty. In order to facilitate the process of emptying and drying the tray 1, the surfaces of the tray 1 may be covered with a hydrophobic material.

Figure 6:
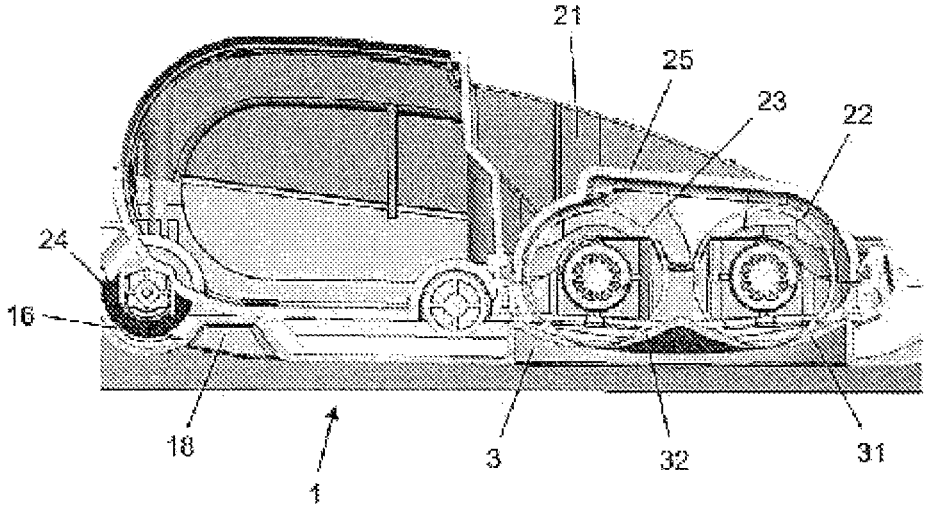
FIG. 6 diagrammatically shows a sectional view of the tray and the head of the cleaning device, in a situation in which the head is in place on the tray.

FIG. 6 shows the mutual position of the head 21 and the tray 1. Preferably, The elevated portion 3 is shaped and positioned such that when the head 21 is in place on the tray 1, the brushes 22, 23 are indented on the basis of contact between the brush hairs and the concave surfaces of the gutter-shaped portions 31, 32 of the elevated portion 3. This enhances the vacuum, which enhances the ability of the cleaning device 2 with the rotating brushes 22, 23 to suck in cleaning liquid from the sides.

When the cleaning action is finished and the tray 1 is empty, the cleaning device 2 is switched off. At that point, the head 21 has been flushed with the cleaning liquid, and all components of the head 21 are cleaned as a result thereof. In the design of the head 21 as shown, it is possible to put a cover 25 which is located at a top side of the brushes 22, 23 to an open position, so that the brushes 22, 23 and the underlying tray 1 can dry.

The cleaning action of the head 21 of the cleaning device 2 by using the tray 1 and an amount of cleaning liquid does not need to take much time. For example, tests have shown that in a practical case, it may be enough to let the cleaning device 2 operate for only 20 seconds, wherein an amount of cleaning liquid of about 250 ml may be used. When contamination of the head 21 is heavy, a user may decide to run a second cleaning action. It is preferred if the tray 1 is shaped such that the level of the cleaning liquid can be in an order of only a few millimeters, as it is easier to put the liquid in motion and supply it to the elevated portion 3 with a lower level than with a higher level.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

The present invention is described in the context of a cleaning device 2 comprising at least one brush 22, 23 having hairs which are extremely flexible, but that should not be understood such as to mean that present invention is limited to that context. The fact is that the present invention is also applicable to brushes having other types of hairs.

The cleaning device 2 may be adapted to exert a suction force at the head 21 during operation, but this is not essential. Realizing an appropriate flow of cleaning liquid inside the tray 1 under the influence of such suction force is a convenient way of carrying out the present invention, but that does not alter the fact that other ways of pumping and displacing the liquid are within the scope of the present invention as well.

It is possible for the tray 1 to comprise means for preventing a user from placing the head 21 wrongly in the tray 1. With the rectangular/square shape of the head 21 and the ring-shaped entirety 13 of standing walls 12 of the tray 1, there is a risk that the user puts the head 21 in the tray 1 in a position which deviates 180° from the appropriate position. A measure which can be taken for avoiding the misplacement is using a protrusion in the tray 1, which is located in the tray 1 in such a way that in the correct position of the head 21 with respect to the tray 1, the protrusion is received in a space which is present in the head 21, and in the wrong position of the head 21 with respect to the tray 1, a bottom component of the head 21 abuts against the protrusion, and causes the head 21 to have an unstable position, which can immediately be noticed by the user. An example of a suitable position of the protrusion is a position at which it extends right between the two brushes 22, 23 when the head 21 is in place on the tray 1. This position is diagrammatically indicated in FIG. 1, wherein an example of the protrusion is shown in dashed lines, and wherein a reference numeral 6 is used to indicate this example.

The present invention can be summarized as follows. After a cleaning device 2 for cleaning surfaces by means of at least one rotating brush 22, 23 has been used one or more times, a head 21 of the device 2, in which the brush 22, 23 is arranged, can be contaminated by particles and/or droplets picked up by the brush 22, 23. The present invention provides a method for conveniently performing the cleaning action of the head 21, and a tray 1 with a relief which is especially adapted to guarantee a proper cleaning action. For the purpose of a cleaning action of the head 21, the cleaning device 2 is put in place on the tray 1, the tray 1 is filled with an amount of cleaning liquid, and the cleaning device 2 is operated for a period of time. During that time, the head 21 is flushed with the cleaning liquid, wherein the at least one brush 22, 23 serves for picking up the liquid from the tray 1 and releasing the liquid in the direction of components of the head 21. According to the present invention, the tray 1 comprises an elevated portion 3, and the brush 22, 23 is positioned at that portion 3, whereby it is achieved that the brush 22, 23 is gradually wetted and can be run in a normal manner. Also, the elevated portion 3 can be used for indenting the brush 22, 23. In order to enhance a flow of liquid towards the elevated portion 3, lowest areas 37, 38 of the tray 1 are located closely to the elevated portion 3, at positions where it is appropriate for the liquid to reach the brushes 22, 23.

The invention claimed is:

1. A combination of a tray and a cleaning device for cleaning surfaces, the cleaning device comprising;

a head having an open side for facing surfaces to be cleaned; and at least one brush for contacting the surfaces to be cleaned, the at least one brush being rotatably arranged in the head, wherein the tray is configured to receive at least a portion of the head of the cleaning device, and to cover the open side of the head, wherein the tray comprises a bottom part and standing walls connected to the bottom part, wherein the bottom part serves for supporting the head of the cleaning device, wherein the standing walls jointly serve for encompassing the head of the cleaning device, wherein the tray comprises two areas, wherein a first area of the two areas is an elevated portion and a second area of the two areas has a surface larger than the first area, wherein the elevated portion protrudes from the bottom part above the surface of the second area towards the head and is located at a position on the bottom part where the at least one brush of the cleaning device is present when the cleaning device is in place on the tray, and wherein the tray is configured to receive and contain a liquid, at least in the second area.

2. The combination according to claim 1, wherein at least a portion of the surface of the second area of the tray comprises surfaces which are slanting towards the elevated portion.

3. The combination according to claim 1, wherein a protrusion is arranged in the tray for avoiding misplacement of the head of the cleaning device in the tray, which is received in a space which is present in the head of the cleaning device in one position of the head with respect to the tray, namely a position in which the cleaning device is in place on the tray, and is abutted against by a component of the head in another position of the head with respect to the tray.

4. The combination according to claim 1, wherein the tray comprises an indicator for determining a maximum level of liquid in the tray, and wherein the tray has at least one notch which is arranged in a ring-shaped entirety of the standing walls of the tray for discharging excess liquid from the at least one notch.

5. The combination according to claim 1, wherein the elevated portion comprises two gutter-shaped portions having concave surfaces.

6. A combination of a tray and a cleaning device for cleaning surfaces, the cleaning device comprising:

a head having an open side for facing surfaces to be cleaned; and at least one brush for contacting surfaces to be cleaned, the at least one brush being rotatably arranged in the head, wherein the tray is adapted to receive and accommodate at least a portion of the head of the cleaning device, and to cover the open side of the head, wherein the tray comprises a bottom part and standing walls connected to the bottom part, wherein the bottom part serves for supporting the head of the cleaning device, wherein the standing walls jointly serve for encompassing the head of the cleaning device, wherein the tray comprises two areas, wherein one of the areas is an elevated portion which protrudes from the bottom part, and which is located at the position on the bottom part where the at least one brush of the cleaning device is present when the cleaning device is in place on the tray, wherein the tray is adapted to receive and contain liquid, at least in another of the areas, wherein spaces are present between the elevated portion and portions of the standing walls of the tray, and wherein areas of the tray which are the lowest as seen in a normal, operational position of the tray with the bottom part down and the standing walls extending upwardly from the bottom part, are present in the spaces.

7. A combination of a tray and a cleaning device for cleaning surfaces, the cleaning device comprising:

a head having an open side for facing surfaces to be cleaned; and at least one brush for contacting surfaces to be cleaned, the at least one brush being rotatably arranged in the head, wherein the tray is adapted to receive and accommodate at least a portion of the head of the cleaning device, and to cover the open side of the head, wherein the tray comprises a bottom part and standing walls connected to the bottom part, wherein the bottom part serves for supporting the head of the cleaning device, wherein the standing walls jointly serve for encompassing the head of the cleaning device, wherein the tray comprises two areas, wherein one of the areas is an elevated portion which protrudes from the bottom part, and which is located at the position on the bottom part where the at least one brush of the cleaning device is present when the cleaning device is in place on the tray, wherein the tray is adapted to receive and contain liquid, at least in another of the areas, wherein at least a portion of the tray is covered with a hydrophobic material.

8. A combination of a tray and a cleaning device for cleaning surfaces, the cleaning device comprising:

a head having an open side for facing surfaces to be cleaned; and at least one brush for contacting surfaces to be cleaned, the at least one brush being rotatably arranged in the head, wherein the tray is adapted to receive and accommodate at least a portion of the head of the cleaning device, and to cover the open side of the head, wherein the tray comprises a bottom part and standing walls connected to the bottom part, wherein the bottom part serves for supporting the head of the cleaning device, wherein the standing walls jointly serve for encompassing the head of the cleaning device, wherein the tray comprises two areas, wherein one of the areas is an elevated portion which protrudes from the bottom part, and which is located at the position on the bottom part where the at least one brush of the cleaning device is present when the cleaning device is in place on the tray, wherein the tray is adapted to receive and contain liquid, at least in another of the areas, wherein the tray comprises means for determining a maximum level of liquid in the tray, comprising at least one notch which is arranged in a ring-shaped entirety of the standing walls of the tray.

9. A combination of a tray and a cleaning device for cleaning surfaces, the cleaning device comprising:

a head having an open side for facing surfaces to be cleaned; and at least one brush for contacting surfaces to be cleaned, the at least one brush being rotatably arranged in the head, wherein the tray is adapted to receive and accommodate at least a portion of the head of the cleaning device, and to cover the open side of the head, wherein the tray comprises a bottom part and standing walls connected to the bottom part, wherein the bottom part serves for supporting the head of the cleaning device, wherein the standing walls jointly serve for encompassing the head of the cleaning device, wherein the tray comprises two areas, wherein one of the areas is an elevated portion which protrudes from the bottom part, and which is located at the position on the bottom part where the at least one brush of the cleaning device is present when the cleaning device is in place on the tray, wherein the tray is adapted to receive and contain liquid, at least in another of the areas, wherein the tray comprises at least three supports at a side which is a bottom side of the tray in a normal, operational position of the tray, and wherein the supports are located at positions which are subjected to pressure by components of the head of the cleaning device when the cleaning device is in place on the tray.

10. A combination of a tray and a cleaning device for cleaning surfaces, the cleaning device comprising:

a head having an open side for facing surfaces to be cleaned; and at least one brush for contacting surfaces to be cleaned, the at least one brush being rotatably arranged in the head, wherein the tray is adapted to receive and accommodate at least a portion of the head of the cleaning device, and to cover the open side of the head, wherein the tray comprises a bottom part and standing walls connected to the bottom part, wherein the bottom part serves for supporting the head of the cleaning device, wherein the standing walls jointly serve for encompassing the head of the cleaning device, wherein the tray comprises two areas, wherein one of the areas is an elevated portion which protrudes from the bottom part, and which is located at the position on the bottom part where the at least one brush of the cleaning device is present when the cleaning device is in place on the tray, wherein the tray is adapted to receive and contain liquid, at least in another of the areas, wherein a ring-shaped entirety of the standing walls of the tray is adapted to snugly surround at least a portion of the head of the cleaning device.

* * * * *